US006217493B1

(12) United States Patent
Spletzer

(10) Patent No.: US 6,217,493 B1
(45) Date of Patent: Apr. 17, 2001

(54) EXERCISE MACHINE FOR EXERCISING LATISSIMUS DORSI MUSCLES AND OTHER MUSCLES

(76) Inventor: David Spletzer, 203 Bay 23rd St., Brooklyn, NY (US) 11214

( * ) Notice: Subject to any disclaimer, the term of this patent is extended or adjusted under 35 U.S.C. 154(b) by 0 days.

(21) Appl. No.: 09/357,278

(22) Filed: Jul. 17, 1999

Related U.S. Application Data

(63) Continuation-in-part of application No. 08/847,872, filed on Apr. 28, 1997, now Pat. No. 5,868,652, which is a continuation-in-part of application No. 08/676,941, filed on May 6, 1996, now abandoned.

(51) Int. Cl.[7] ..... A67B 23/035
(52) U.S. Cl. ..... 482/103

(58) Field of Search ..... 482/99–103, 112, 482/113, 129, 130, 133

(56) References Cited

U.S. PATENT DOCUMENTS 4,603,855 * 8/1986 Sebelle ..... 462/102
5,102,122 * 4/1992 Piane, Jr. et al. ..... 482/103
5,466,204 * 11/1995 Nearing ..... 482/102
5,725,459 * 3/1998 Rexach ..... 482/102

* cited by examiner

*Primary Examiner*—John Mulcahy
(74) *Attorney, Agent, or Firm*—Richard B. Klar

(57) ABSTRACT

The present invention is an exercise machine for exercising latissimus dorsi muscles, chest muscles and other muscles. The invention includes moveable arms so that the distance between the arms can be varied to accommodate the size of a user or to change the type of exercise.

10 Claims, 4 Drawing Sheets

EXERCISE MACHINE FOR EXERCISING LATISSIMUS DORSI MUSCLES AND OTHER MUSCLES

This application is a CIP of Ser. No. 08/847,872, filed Apr. 28, 1997, now U.S. Pat. No. 5,868,652, which is a CIP of Ser. No. 08/676,941, filed May 6, 1996, abandoned.

The present application is based on the disclosure document filed on Nov. 13, 1997 bearing Disclosure Document No. 426898.

I. BACKGROUND OF THE INVENTION

1. Field of the Invention

The present invention relates to an exercise machine that exercises latissimus dorsi muscles and other muscles. In practice the present invention relates to an exercise machine having movable arms for adjusting the distance between the two arms for a user's size or for the type of exercise to be performed.

2. The Prior Art

The prior art discloses that cable or belt functioning pulldown style machines utilize a single extending and immovable arm from which a bar of varying lengths is suspended from the cable or belt. The user is forced to adjust for shoulder width and type of exercise by moving his hands along said bar. This being the case, even while facing a mirror the tendency may exist to twist the bar, favoring one's stronger side and resulting in asymmetrical muscle development. It is, however, desirable to provide a machine where two arms are utilized that are movable and can be adjusted for both the size of the user as well as to vary the type of exercise to be performed.

II. SUMMARY OF THE INVENTION

It is a principal object of the invention to provide an exercise machine with two arms adjustable for varying the distance in between.

It is still another object to provide an exercise machine with adjustable arms where the arms are easy to adjust and can be easily adjusted.

It is yet another object to provide an exercise machine for exercising the latissimus dorsi muscles, chest muscles and other muscles when the arms of the machine can be adjusted for the type of exercise or for the user's size.

Other objectives will become apparent from the foregoing description and drawings in which:

III. BRIEF DESCRIPTION OF THE DRAWINGS

IV. DETAILED DESCRIPTION OF THE PREFERRED EMBODIMENT

Figure 1:
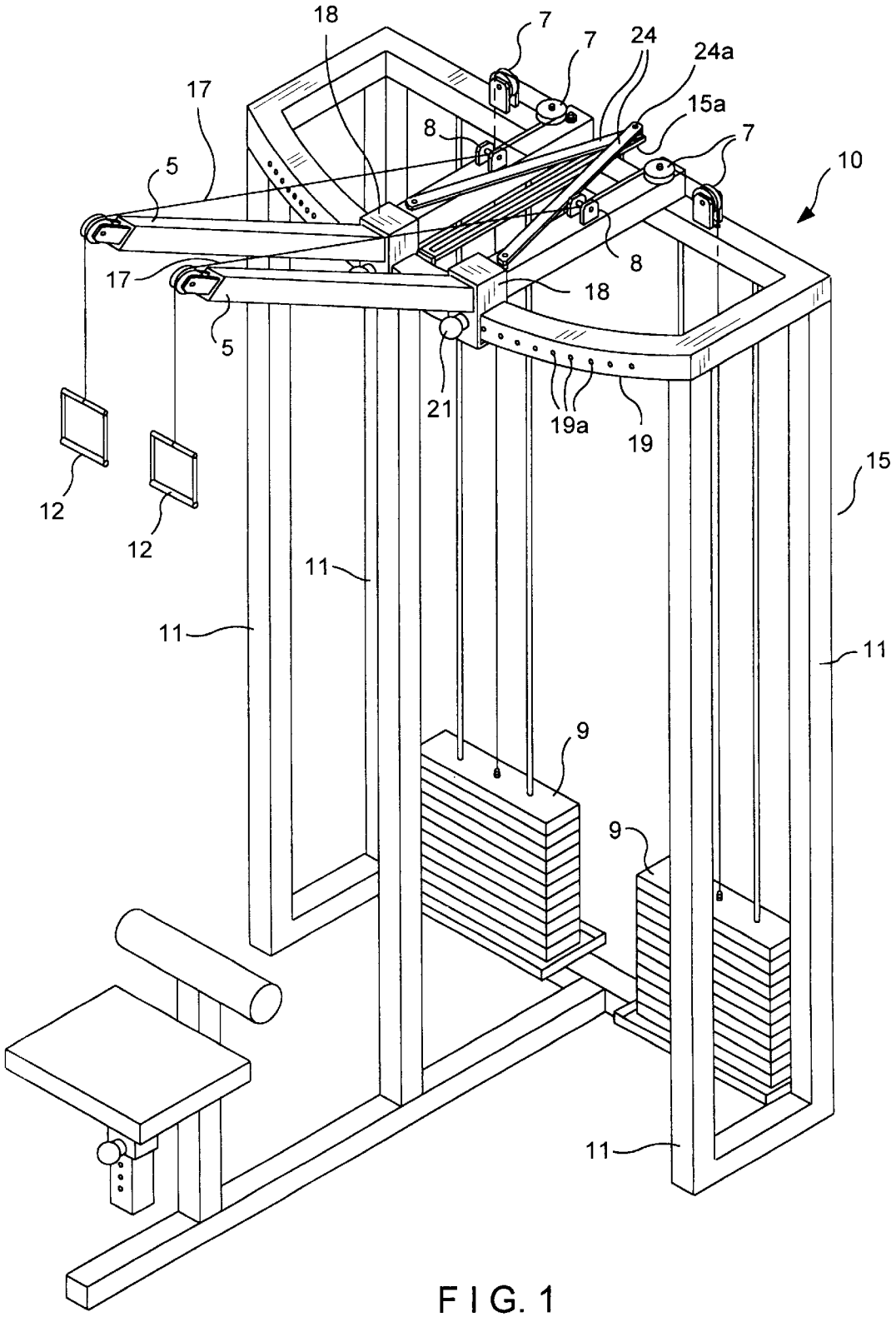
FIG. 1 is a perspective view of the present invention.

Referring to FIGS. 1–4 of the drawings, the present machine as shown in FIG. 1 relates to an exercise device 10 which includes a support 15 which provides substantially vertical support by vertical legs 11 to a pair of arms 5 which are connected through pulleys 7 and rollers 8 to weights 9 for the exercise device 10.

Attachment means 17 such as cables 17 (shown), belts (not shown) or any other suitable alternative means connect the arms 5, pulleys 7, rollers 8 and weights 9 of the exercise device 10. Gripping means 12 suited for gripping by the hands a user (not shown). The gripping means can be handles as shown in FIG. 1.

Figure 3:
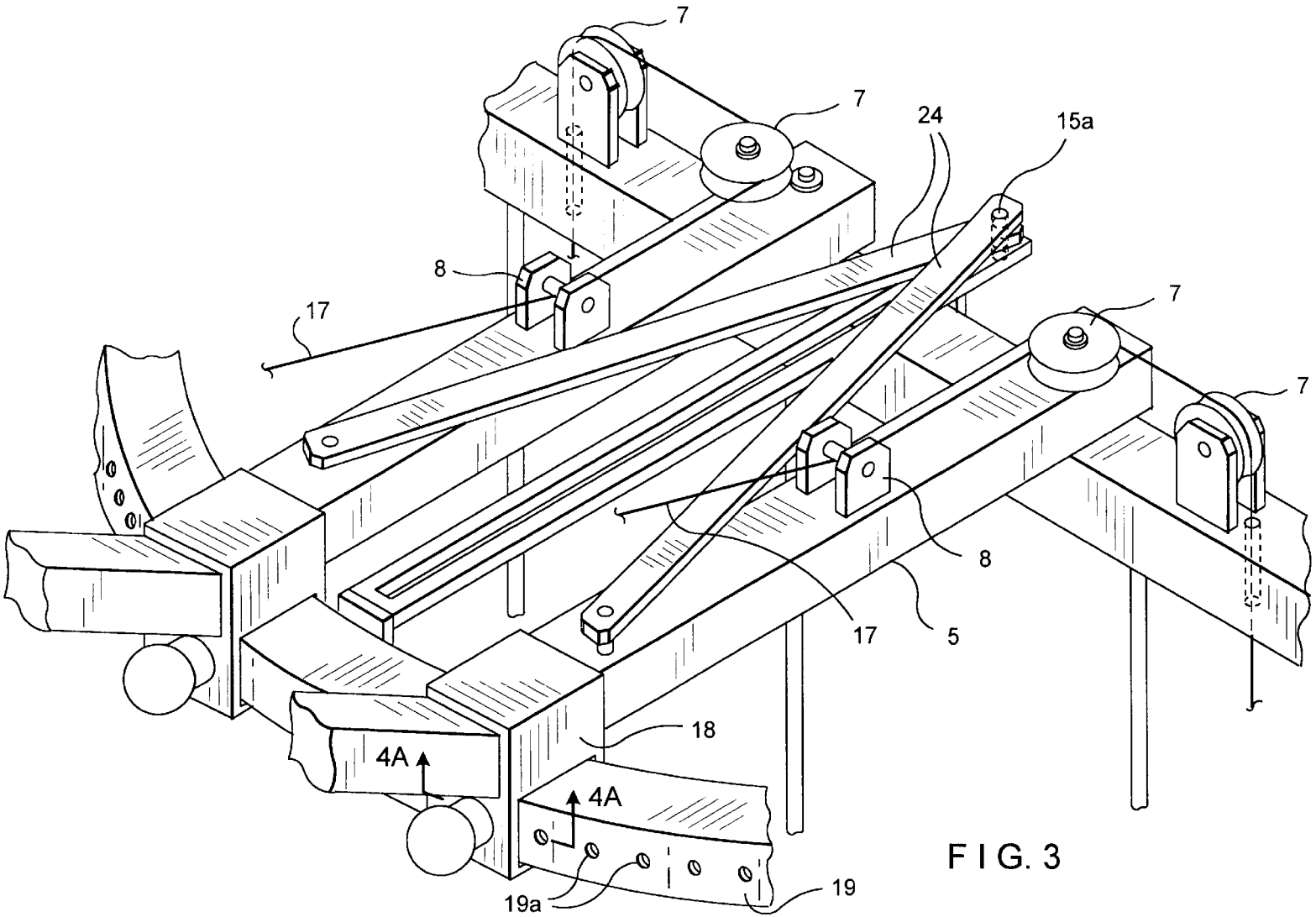
FIG. 3 is a partial prospective view of the top portion of the present invention.

Each of the arms 5 extend through the respective faces of the sleeves 18 preferably extending outward upwardly at an angle as shown in FIGS. 1 and 3. Each sleeve 18 extends over a track 19 which is part of the support structure 15 and is preferably curved as shown in FIGS. 1 and 3. The track has holes 19*a* in a portion of its front face 19*b* as shown in FIG. 3. At least one of the sleeves has a removable pin 21 which goes through an opening in the face of the sleeve 18 and also through one of the holes 19*b* of the track 19. In this way one arm 5 can be moved and set in place by the pin 21 being placed in another hole 19*a* of the track 19 when one arm 5 is moved closer or further from the other arm 5. It is only necessary to move one arm 5 to vary the distance between the two arms 5.

Figure 2:
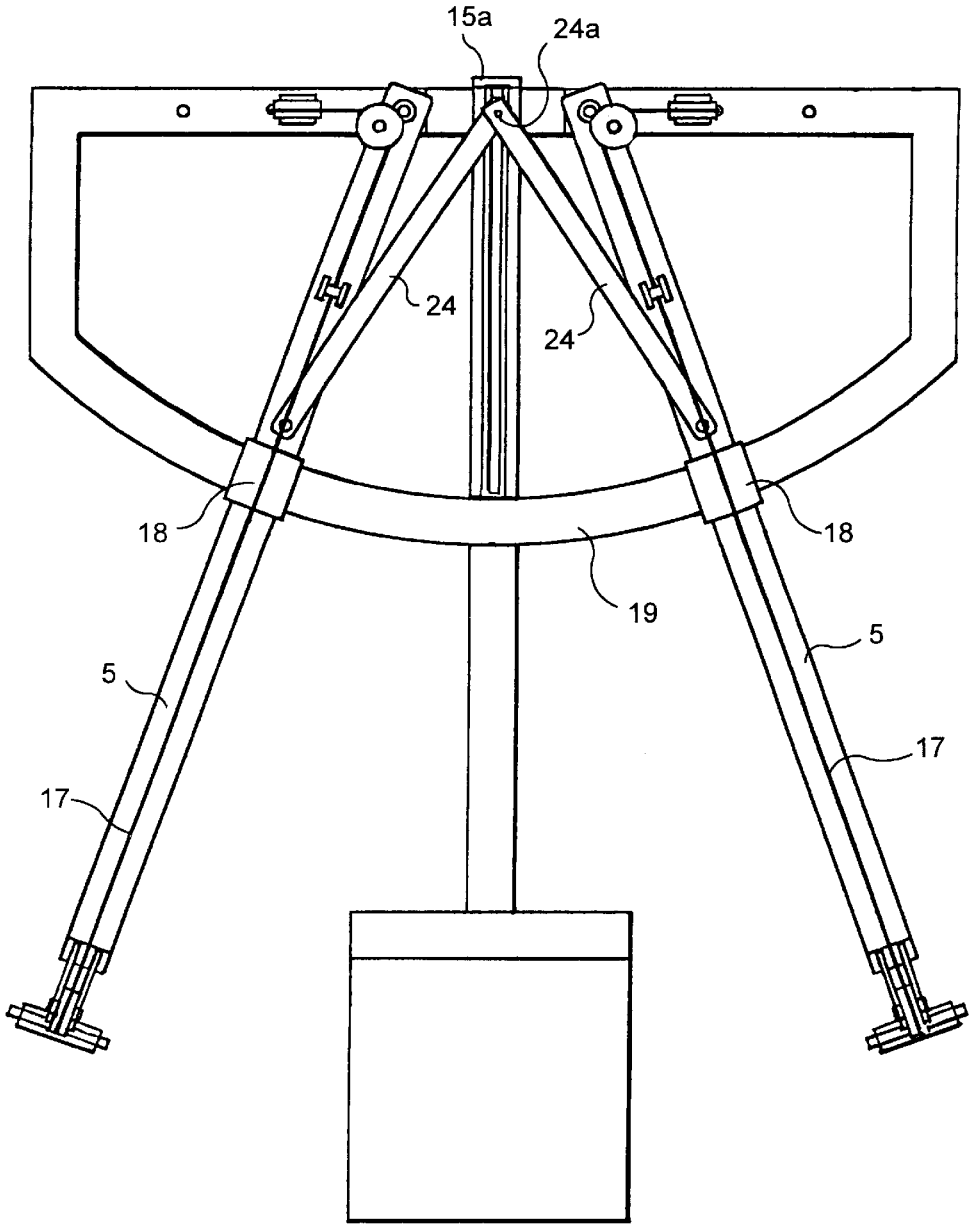
FIG. 2 is a top view of the present invention.

Guide means such as guide rods 24 are provided to assist in moving the arms 5. One rod 24 is located a distance above the other rod 24 as seen in FIGS. 2 and 3 so as to provide free movement of the rods, without one rod 24 being in the path of the other rod 24 during its rotational movement. The rods are connected to each other and to a center track 15*a*, at one end near the back of the support structure 15 as shown in FIGS. 2 and 3. The support structure 15 has a top surface which includes center track 15*a* on which said guide rods 24 are pivotally mounted in a groove 15*a* by means of a pivotal pin member 24*a* near the back of the support structure 15 so that when one of the guide rods moves the other rod moves with it as shown in FIG. 3.

Figure 4A:
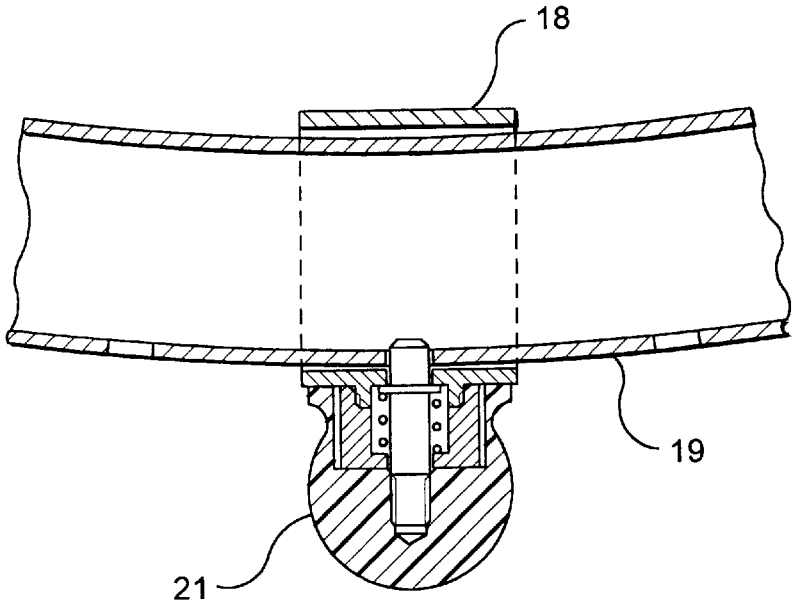
FIG. 4 is a sectional view taken along lines 4A—4A of FIG. 3.
Figure 4B:
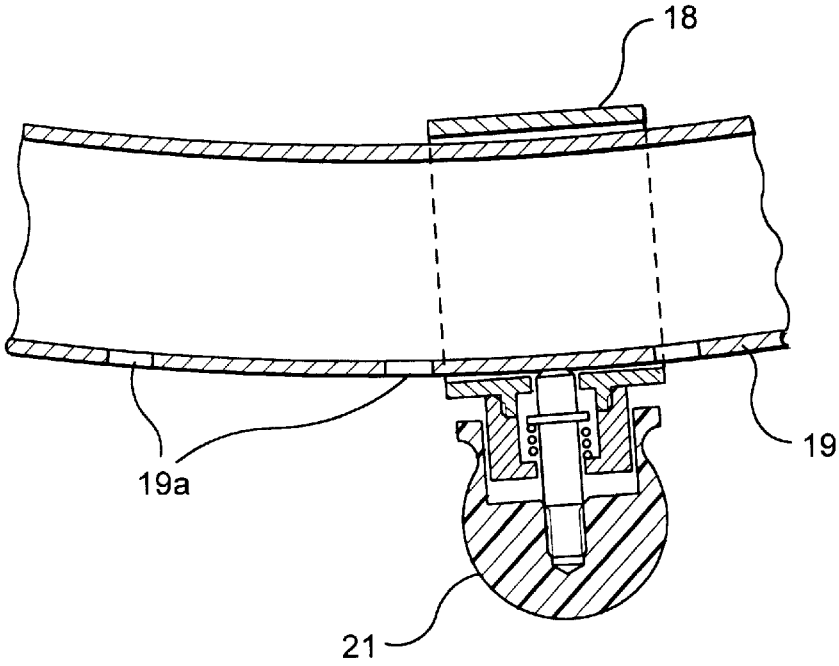

FIG. 4 shows movement of one of the sleeves 18 along the track 19. A portion of the sleeve 18 wraps around the arm 5.

In operation, the exercise machine 10 operates as follows:

The arms 5 are positioned a suitable distance apart to accommodate the size of a user. Thus a larger sized user would require the arms 5 to be spaced further apart from each other than a smaller sized user with narrower shoulders. By removing the pin 21 from one of the sleeves 18 the sleeve 18 and the coupled arm 5 can be moved along the track 19 by the sleeve 18 by moving along the track 19 and the pin 21 is then inserted into a hole 19*b* of the track 19 further away from both the other arm 5 and the hole the sleeve was previously inserted into. It is only necessary to move one arm 5 and one sleeve 18 by the track 19 to vary the distance between the arms 5.

One may also vary the distance between the arms for changing the type of exercise performed. For example, by keeping the arms 5 closer together a user can exercise his inner back muscles. By keeping the arms 5 farther apart the latissimus dorsi muscles, outer back muscles and shoulders can be exercised.

To perform exercises a user can grip the gripping means shown as handles 12 in FIG. 1 which are connected by cables 17 to weights 9. The weights 9 can be varied. It is understood that other weight varying mechanisms can be utilized with the invention. A leg bar 27 is provided only with a support table 28 which can be adjusted for height of the user by a pin and hole mechanism 30.

I do not limit myself to any particular details of construction set forth in the specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desired to be secured by Letters Patent is as follows:

1. An exercise machine adapted for exercising latisimus dorsal muscles and other muscles comprising:

a pair of moveable arms which includes guide means pivotally connected to said moveable arms to cause said moving arms to move dependently of each other, said moveable arms being connected to a support structure for said arms and extending outwardly in front of said support structure;

means for moving said arms to vary a distance between said arms,;

attachment means connected at one end to weights by pulleys connected along said support structure and said attachment means at another end being connected to gripping means for a user to grip wherein said arms can be adjusted at any distance for a user's size and to vary a type of exercise for a user.

2. The exercise device according to claim 1 wherein said means for moving said arms includes a horizontally disposed track and means for removable fastening said arms to different locations along said track.

3. The exercise device according to claim 2 wherein said track is curved and has holes therein and on sleeves through which said arms extend, said sleeves each have face plates, at least one of said face plates having a retractable pin adapted to be inserted in a respective one of said holes of said track so that said arms can be moved to different locations along said track.

4. The exercise device according to claim 2 wherein said track is at least partially curved.

5. The exercise machine according to claim 1 wherein said guide means includes a pair of guide arms each having two ends, one end of each said guide arm being pivotally connected to a respective one of said moveable arms and another end being pivotally connected together to a rear part of said support structure, one of said guide arms being located above another of said guide arms to permit said guide arms to rotate freely in moving said movable arms without interfering with one another.

6. The exercise device according to claim 1 wherein said attachment means are cables.

7. The exercise device according to claim 1 wherein said attachment means are belts.

8. The exercise device according to claim 1 wherein said one of said sleeves partially wraps about one of said arms to secure said one of said arms in place when moving along said track.

9. The exercise device according to claim 1 wherein said gripping means are hand held handles.

10. The exercise machine according to claim 1 wherein said guide means includes a pair of guide arms pivotally connected to said moveable arms and said guide arms are pivotally connected together so as to cause said moveable arms to move dependently of each other.

* * * * *